US006383352B1

(12) United States Patent
Shyu et al.

(10) Patent No.: US 6,383,352 B1
(45) Date of Patent: May 7, 2002

(54) SPIRAL ANODE FOR METAL PLATING BATHS

(75) Inventors: Jieh-Hwa Shyu, Andover; Peter V. Kimball, Harvard, both of MA (US)

(73) Assignee: Mykrolis Corporation, Bedford, MA (US)

( * ) Notice: Subject to any disclaimer, the term of this patent is extended or adjusted under 35 U.S.C. 154(b) by 0 days.

(21) Appl. No.: 09/438,452

(22) Filed: Feb. 14, 2000

Related U.S. Application Data

(60) Provisional application No. 60/108,224, filed on Nov. 13, 1998.

(51) Int. Cl.[7] ..... C25B 11/04

(52) U.S. Cl. ..... 204/292; 204/282; 204/288.1; 204/280

(58) Field of Search ..... 204/288.1, 292, 204/280, 283, 282; 429/94

(56) References Cited

U.S. PATENT DOCUMENTS 4,048,042 A 9/1977 Quinn ..... 204/206
4,059,493 A 11/1977 Rice ..... 204/280
4,707,421 A * 11/1987 McVeigh, Jr. et al. ..... 429/94
6,238,819 B1 * 5/2001 Cahill ..... 429/162

FOREIGN PATENT DOCUMENTS

WO WO 98/39796 9/1998

* cited by examiner

*Primary Examiner*—Bruce F. Bell
(74) *Attorney, Agent, or Firm*—Timothy J. King; Mykrolis Corporation

(57) ABSTRACT

A metal anode having at least a portion of which formed in a spiral configuration is disclosed. The spacing between the adjacent spirals of the anode is essentially uniform in order to provide uniform fluid flow and electrical characteristics. The anode may be formed of a metal rod or sheet or may be cast from a metal. The anode surfaces of the spiral may be flat or have a configuration such as a corrugated surface to enhance the surface area of the anode. The use of spacers, electrically conductive or insulative, within the spaces between the spirals to maintain their uniform distance is also disclosed. The use of one or more buss bars enables the anode to be supplied with a constant electrical source and may also function as a means for monitoring anode consumption over time. The anode is preferably used in an electroplating bath as the source of the metal used for plating. This is particularly of value in the electroplating of silicon wafer surfaces.

12 Claims, 6 Drawing Sheets

SPIRAL ANODE FOR METAL PLATING BATHS

Presented for filing is a new application that claims priority to U.S. provisional application No. 60/108,224, filed Nov. 13, 1998.

The present invention relates to anodes used in metal plating baths. More particularly, it relates to spiral anodes used as the source of metals to be plated in metal plating baths.

BACKGROUND OF THE INVENTION

It is well known to plate metal onto another surface. Of particular interest, is the recent desire to form copper surfaces on semiconductor surfaces in lieu of aluminum wiring. Copper plating has been considered as the most viable method of doing so.

The metal is deposited onto the silicon wafer by an electrochemical deposition process where the silicon wafer acts as the cathode and the copper or other insoluble metal acts as the anode. To obtain uniform copper deposition, uniform, high velocity fluid flow of the electrolyte and uniform electrical field are necessary to promote better mass transport, electrical current distribution to reduce additives consumption and to prevent anode passivation.

While the design of the plating cell and the fluid flow are critical to obtain desired plating uniformity, the design of the anode is also critical to the plating uniformity and low consumption of additives and energy. It is generally desirable for the anode to have uniform, high fluid flow throughout, a large anode surface area and a uniform electrical potential. Moreover for soluble copper anodes, uniform dissolution of copper to minimize change in anode shape is desired.

In order to accomplish these requirements, soluble copper anodes have been made of copper beads or shot which have been enclosed within a porous compartment. Alternatively, a solid copper or insoluble copper plate or disk has been used. In these designs, numerous holes or slots may be formed in order to create increased surface area and flow channels that allow for fluid flow through the anode. Alternatively, fluid may flow around the anode for agitation.

The approach using copper shot(s) in a casing is less desirable due to relatively poor electrical contact between the copper particles and the related anode buss as they are dissolved over time.

The approach using the metal disk or plate requires mechanical machining or some other technique to create the flow openings (holes or slots). This leads to the scraping of a large amount of valuable metal, Further, as the metal dissolves, the flow characteristics change as the holes or slots vary in width (typically going larger as the metal dissolves). Additionally, there is a delicate balance between the number of holes or slots formed in the metal disk or plate and the flow characteristic and plating uniformity obtained. If there are too few, one does not obtain the desired flow characteristics and plating uniformity. If there are too many or if the holes or slots are too big, the electrical field distribution is changed in an adverse way. Furthermore, since it is desirable to have similar geometry between the anode and the cathode for better electrical field distribution, the disk anode may be passivated at high speed plating applications. Typically the anode to cathode surface area ratio should be 2 to 3.

Lastly, in all of these approaches, there is no easy method to monitor the consumption of the anode over time.

What is desired is an anode that provides the uniform, high fluid flow, large surface area, minimum change in flow and electrical characteristics and uniform electrical field distribution with a means to monitor consumption over time in a plating system. The present invention provides such a device.

SUMMARY OF THE INVENTION

The present invention is a metal anode that has at least a portion formed in a spiral configuration with defined spacing between the adjacent spirals in order to provide fluid flow characteristics. Preferably, the anode is formed of one or more metal strips that are formed into a spiral pattern including a single spiral, a double spiral, serpentine spiral and a zigzag spiral. The strips may be made of metal rods or sheets. The strips may be relatively flat or may contain various surface patterns such as corrugated surfaces, grooves, holes or other such devices to enhance fluid flow. Preferably, the strips are wider than their thickness and the strips are longer than their width. The spiral configuration is formed either by casting, cutting or by winding the metal strip into the desired spiral pattern. Desirably, rods or screws may be inserted radially through the layers of the spiral in order to provide uniform spacing and or mechanical rigidity to the anode. Using metal rods or screws not only provides the spacing and rigidity but also helps to reduce the electrical resistance along the strips. Additionally, when electrical contacts are made at two locations of the spiral, it allows one to measure the change in resistance in the anode over time and thus monitor the condition of the anode so one may change the anode at the appropriate time. Lastly, one or more buss bars or electrical connections may be made to minimize voltage drop in the anode during use.

It is an object of the present invention to provide a metal anode comprising one or more metal strips at least a portion of which are formed into a spiral configuration and wherein each layer of the spiral is uniformity spaced apart from the adjacent layer of the spiral.

It is a further object of the present invention to provide a soluble anode comprising one or more metal strips, at least a portion of which are formed into a spiral configuration and wherein the anode contains a separate metal strip of the same metal as the anode which strip is used to monitor the consumption of the anode by electrical resistance measurement.

It is another object of the present invention to provide a system for electroplating comprising two or more cathodes formed of a material on which a metal is to be plated, two or more anodes formed of a metal from which the two or more cathodes are to be plated, said two or more anodes each having at least a portion being formed in a spiral configuration, wherein each layer of the spiral of each of the two or more anodes is uniformity spaced apart from the adjacent layers of the spiral, said two or more anodes being arranged such that the spiral configurations are parallel to the surface of the two or more cathodes and an electrolyte which flows through the spirals of the two or more anodes from a surface of the anode farthest from the two or more cathodes to the surfaces of the two or more cathodes.

IN THE DRAWINGS

DETAILED DESCRIPTION OF THE INVENTION

Figure 1:
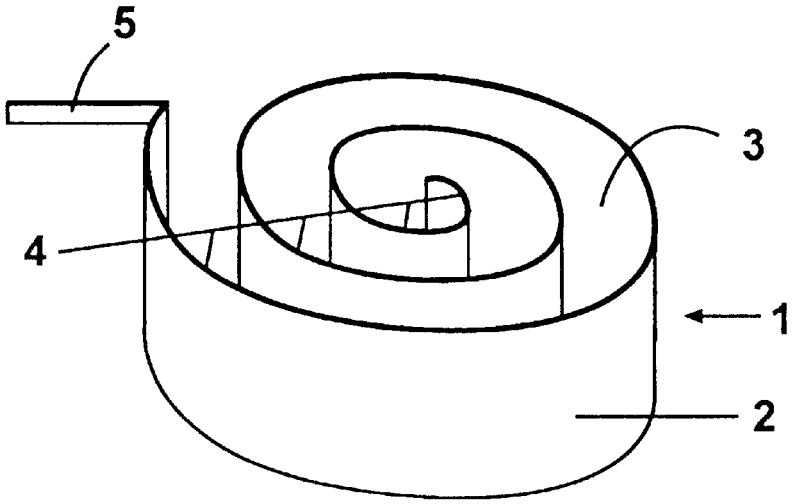
FIG. 1 shows an overall perspective view of an anode according to a first preferred embodiment of the invention.

The present invention relates to an anode wherein at least a portion of the anode, preferably all of the anode is formed in a spiral configuration, an embodiment of which is shown in FIG. 1. The anode 1 is formed of one or more metal strips 2. The strips may be in the form of a rod or the sheet. In this embodiment, the entire strip is formed into a spiral configuration. The one or more strips are formed into a spiral configuration with relatively uniform spacing 3 between the layers 4 of the spiral. One or more buss bars 5 may connected to the anode in order to provide an electrical connection between an external electrical source and the anode.

The anode may be formed of any conductive material that is typically used in the formation of an anode. It may be a soluble material so that it may function as the source of metal in an electroplating bath. Alternatively, it may be formed of an insoluble material and simply function as an insoluble anode. Additionally, it may be formed of a soluble or insoluble metal that has been plated or coated with an insoluble metal so as to form an insoluble anode. Preferably, it is formed of a soluble metal, metal alloy or doped metal such as copper, lead, tin, gold, or silver, their alloys, in particular copper and lead alloys, blends such as lead/tin blends and doped metals such as phosphorous doped copper. Insoluble materials include but are not limited to carbon, titanium and platinum. Suppliers of metal are well known to those of one of ordinary skill in the art. Preferred suppliers include Olin Metals of Stamford, Conn. and Johnson Mafthey of Eden Prairie, Minn.

As mentioned above, the anode strip may be formed of one or more rods or sheets of material. By rods, it is meant metal bars, wires and other well-known shapes where the length of the material is significantly greater than the diameter of the material. Typically the length to diameter ratio is greater than 10, preferably greater than 20, more preferably greater than 50. Such rods can include various metal wires of varied thicknesses, metal bars of circular, rectangular, ovoid or other available polygonal shapes.

By sheet, it is meant any relatively thin strip-like material such as metal foil, metal ribbons or metal plate. Typically, the sheet material will be formed of a metal foil or plate either of a rectangular or square configuration, however other configurations such as ovoid shapes, triangular or circular shapes may be used. The sheet must be of a thickness such that it is easily bent or otherwise formed into the spiral configuration.

Figure 2:
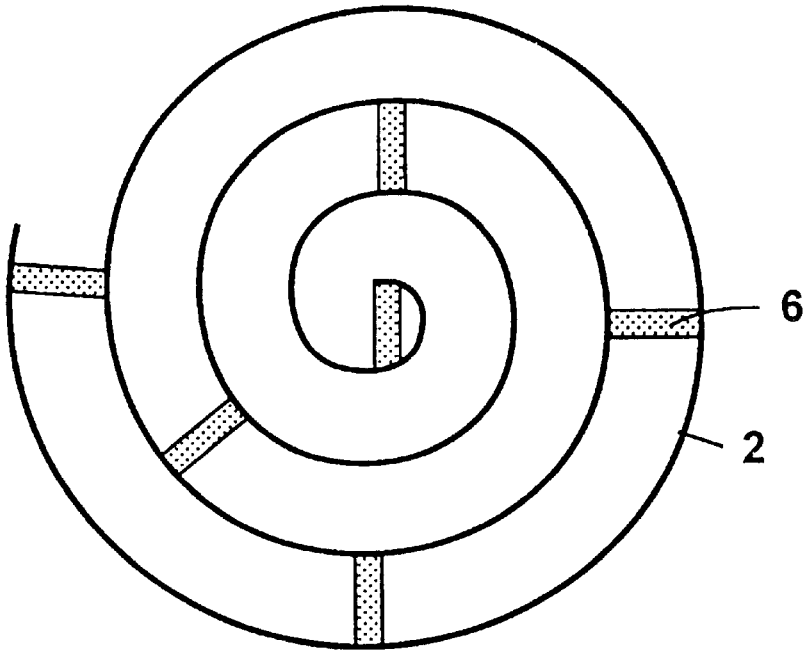
FIG. 2 shows a second preferred embodiment of the present invention in a top down view.

FIG. 2 shows a similar embodiment to that of FIG. 1. In this embodiment, one or more spacers 6 are used between the layers 4 of the spiral to maintain the uniform spacing between the layers. The spacers may be either conductive or insulative. These spacers may form part of the anode material itself, as described below, or may be separate from the anode material. If separate, one may attach the spacers to the surface of the anode if desired by various means such as mechanical connections including crimping the spacers to the anode material or using screws or rivets, chemical means such as adhesives or other means such as soldering or welding. Alternatively, the spacers may be separate from the anode material and simply be retained within the spaces between the layers by the formation of the spiral anode itself.

If the spacers are conductive, they preferably are formed of the same metal as the strip. Moreover, these conductive spacers may be formed as a part of the metal strip itself. For example, a sheet of metal may have a series of ridges spaced uniformity apart on at least one of its surfaces.

Alternatively, they may be formed of a separate material. In this configuration, they may be attached to the anode by various means such as mechanical means including crimping or screws or rivets, chemical means such as adhesives or other means such as soldering or welding.

Figure 3:
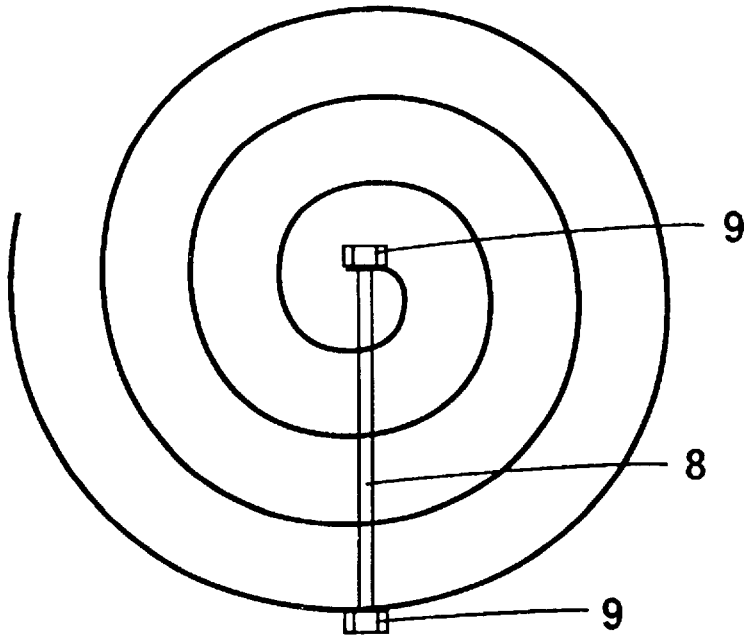
FIG. 3 shows a top down view of a third embodiment of the present invention.

In one embodiment, as shown in FIG. 3, the spacers are formed of a series of rods or screws 8,either conductive or insulative, which are threaded through the layers of the anode. In this embodiment, the rods or screws 8 may be arranged parallel and apart from each other as shown in the drawing. Alternatively, the spacers 8 are formed radially through the layers of the spiral. These spacers 8 function both as the means for maintaining the uniformity of space between the spiral layers and as a stiffener for the anode overall. In this arrangement, depending upon the length of the spiral, one may need to use a series of such spacers 8 along the length in order to provide the spacing and stiffening purposes to the entire anode structure.

When one selects conductive spacers, they may be formed from such materials as that of the anode itself. These materials are the various anode metals, alloys, and doped metals such as copper, nickel, silver, gold, titanium or platinum. Alternatively, they may be formed of a different conductive metal, or carbon.

When one selects insulative spacers, they may be formed from such materials as glass including glass rods, strips or glass mats, plastic such as polyethylene, nylon, polytetrafluoroethylene (PTFE), polyethylene terephthalate (PET), epoxies and other well known plastics in rod, strips, screws or mat form, ceramics and/or metal oxides, typically in the form of rods or strips although fibrous mats or other porous mats may be used.

Figure 4:
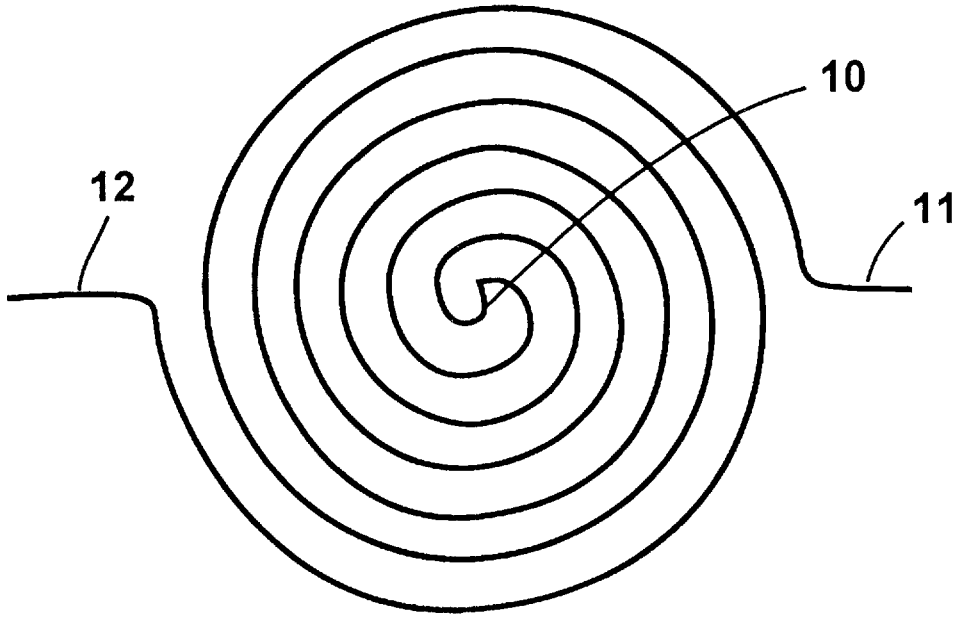
FIG. 4 shows a further preferred embodiment of the present invention having a double spiral in a top down view.

A further embodiment is shown in FIG. 4. In this embodiment, the use of two buss bars 11 and 12 are formed as integral portions of the anode and are formed into a spiral configuration. In this design, the anode is formed such that two spirals, 10A and 10B, are formed. The first buss bar 11 extends from one end of the spiral and the second buss bar 12 extends from the other end of the spiral.

The one or more buss bars are attached to the anode in a variety of ways. It may be a portion of the anode itself. For example, when the anode is formed of a metal rod, one buss bar may be formed simply by an extension of the rod itself. This is shown in FIG. 1.

Figure 5:
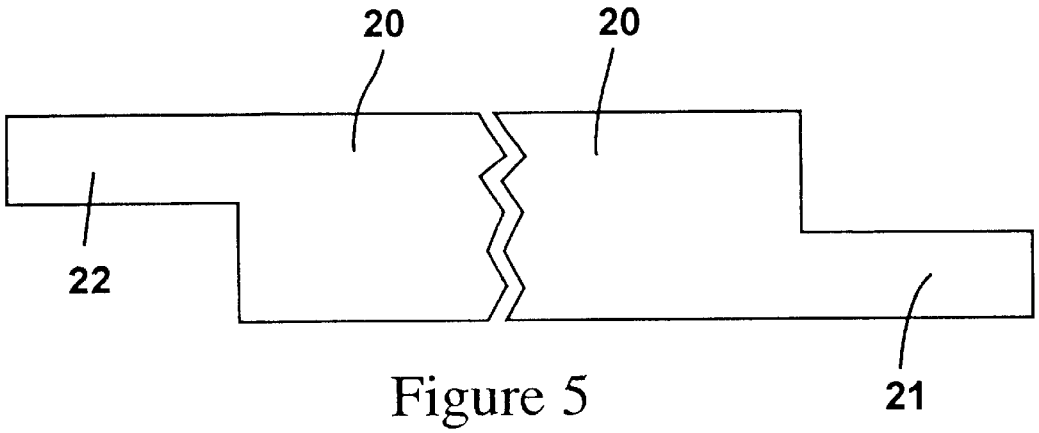
FIG. 5 shows a perspective view of the anode material having integral buss bar or bars before it is formed into the desired spiral configuration.

Alternatively, when the anode is formed of sheet of metal such as a piece of metal foil or thin metal plate, one or more buss bars may simply be an extension of that sheet. FIG. 5 shows just such an anode before it has been formed into its spiral configuration. The sheet 20 has two extensions 21 and 22 that have of a diameter less than that of the sheet 20 itself and extending like arms out from the sheet. In the embodiment of FIG. 5, the extension 21 that forms the buss bar is shown at one end of the sheet 20. The other extension 22 extends from the other end of the sheet 20. The number and position of the extensions 21 and 22 is only limited by the ability to form the spiral configuration while providing the buss bar feature and therefore may be along any surface of the sheet 20.

Lastly, the buss bar may be formed of a separate piece of conductive material, preferably metal, preferably of the same metal as the anode itself in order to avoid galvanic coupling. It may be mechanically attached to the anode such as by crimping or screws or rivets, or it may be attached by soldering or welding it to the anode surface. If desired, the surface of the buss bar may be coated with a chemically resistant, electrically insulative material such as natural or synthetic rubber, epoxy, and other polymers.

The use of the buss bars allows one to either supply electrical current to the anode or to measure the electrical resistance of the anode over time so that one may determine the performance of the anode and in the embodiment of the anode used as the metal supply for the bath, to determine when the anode should be changed.

The consumption of the anode during use may be monitored by measuring the resistance change of the anode as it is consumed. There are several ways of determining the resistance change. Examples include the four-point probe technique commonly used to determine the thickness of conductive thin films. It is accomplished by monitoring the voltage between two fixed locations of the anode by two voltage sensing probes, at a constant DC, AC or AC superimposed on DC current supplied by the other pair of contact points. Another, but less accurate technique is to supply electrical current between two contact points and monitor the voltage difference at these two points. In both cases, the sensitivity and accuracy are poorer for highly conductive material, such as solid copper anode disks, or with an ill-defined geometry, such as copper shots.

With a continuous anode, the well-defined geometry and long length between two sensing points allows greater accuracy in determining the amount of anode material dissolved. The amount of anode material is proportional to the cross sectional area (thickness times width) of the anode strip, which is inversely proportional to the electrical resistance of the strip. It is preferable, but not critical to have the two sensing points at the opposite ends of the metal strip.

The electrical resistance of the anode can be determined by a conventional ohmmeter, or a voltage meter and a current source between two sensing points. To obtain the best accuracy, care must be taken not to electrically short circuit a significant portion of the anode between the two sensing points by either the use of electrically conductive spacers or the touching of adjacent strips.

Alternatively, in measuring the consumption of a soluble anode, one may use a separate piece of metal, preferably formed of the same metal as the anode itself either located adjacent to or attached to the anode and measure the electrical resistance of that separate strip of metal to determine the consumption of the anode itself.

Figure 6:
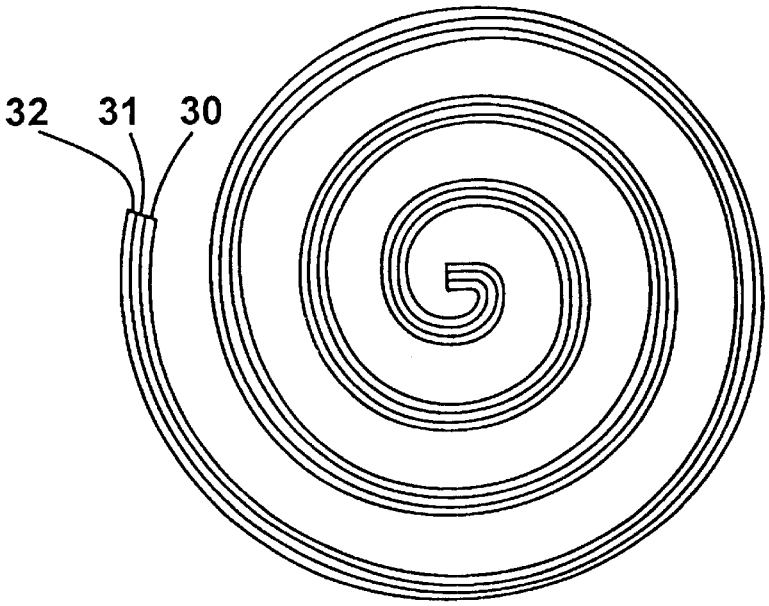
FIG. 6 shows another preferred embodiment of the present invention using multiple stacked strips to form the anode in a top down view.

FIG. 6 shows an embodiment in which more than one strip is used to form the anode. In the embodiment as shown, the anode 20 is comprised of a series of two or more strips, in this example three strips 30,31,32 which are formed together into the anode configuration. The strips 30,31 ,and 32 are preferably formed of the same material and have the same overall dimensions in order to provide for uniform dissolution of the anode. If desired or required, the various layers may be held together by spacers as described above.

Figure 7:
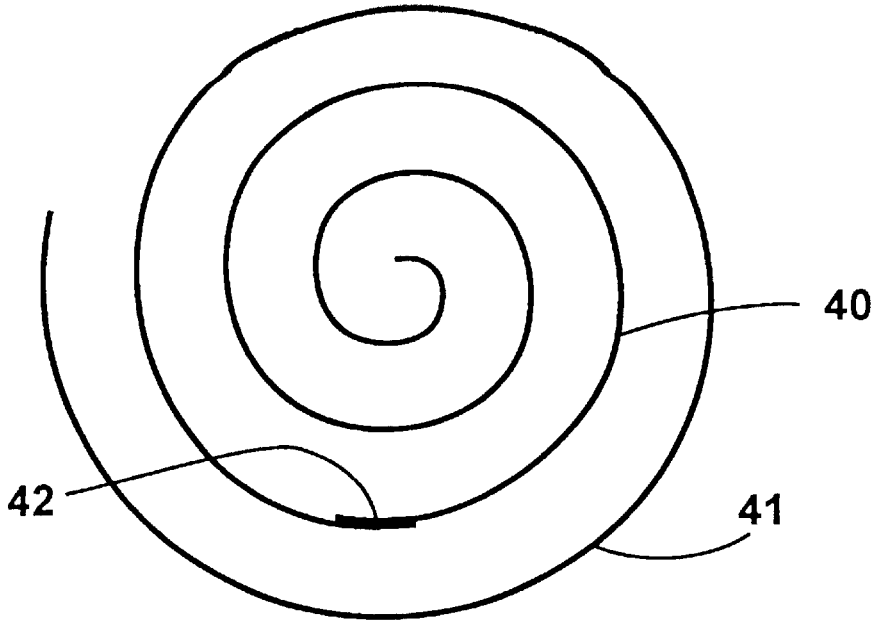
FIG. 7 shows another preferred embodiment of the present invention using multiple strips to form the anode in a top down view.

FIG. 7 shows an embodiment in which more than one strip is used to form the anode. However, unlike the embodiment of FIG. 6, the anode is formed of layer of material extended through out the spiral. Here, rather than using one continuous strip of material, a series of strips 40 and 41 are formed end to end in order to create the desired spiral anode. In such an embodiment, the strips may simply be stacked together and rolled into the desired shape. Alternatively, they may be attached to each other in a manner that maintains the electrical contact across the strips. For example, they may be welded as shown in the Figure at 42 or soldered to each other or they may be mechanically attached such as by crimping or using screws or rivets or other such devices to maintain the sheets together.

Figure 8:
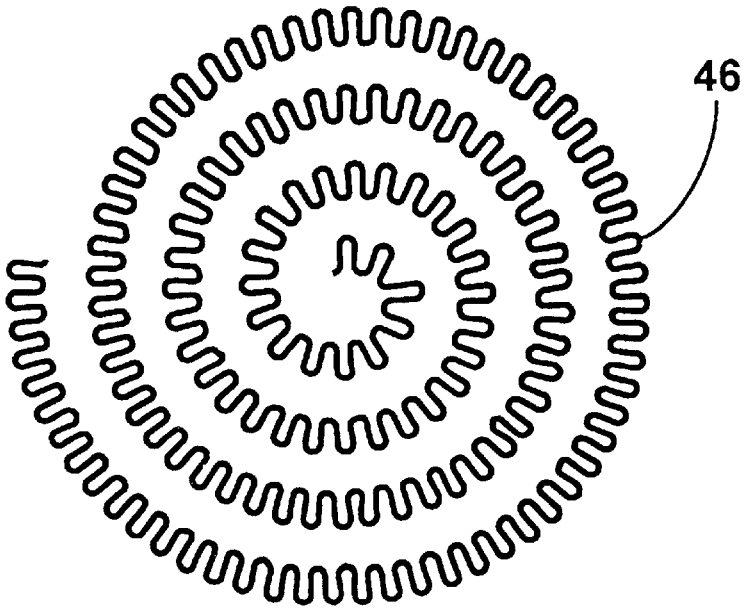
FIG. 8 shows a further preferred embodiment of the present invention using a corrugated surface in a top down view.

While the embodiments shown above have all used relatively flat surfaced materials, this is not a requirement and any surface configuration of the material may be used. Typically, if one uses some surface configuration other than flat, it should be uniform and provide additional surface area for the anode. For example, one may use a corrugated sheet in forming the anode. This is shown in FIG. 8. In this embodiment, one may arrange the corrugations 46 such that they nest within the corrugations of the next innermost spiral or arrange the corrugations such that they do not nest (as shown in FIG. 8). To prevent nesting, one may simply arrange the spiral configuration such that nesting does not occur. Alternatively, the use of spacers will prevent nesting from occurring. Other surface configurations may also be used such as having lines or spaces formed in at least one surface of the material forming the anode so as to create additional surface area. Alternatively, one or more openings such as holes may also be formed in the material of the anode in order to increase surface area.

Figure 9:
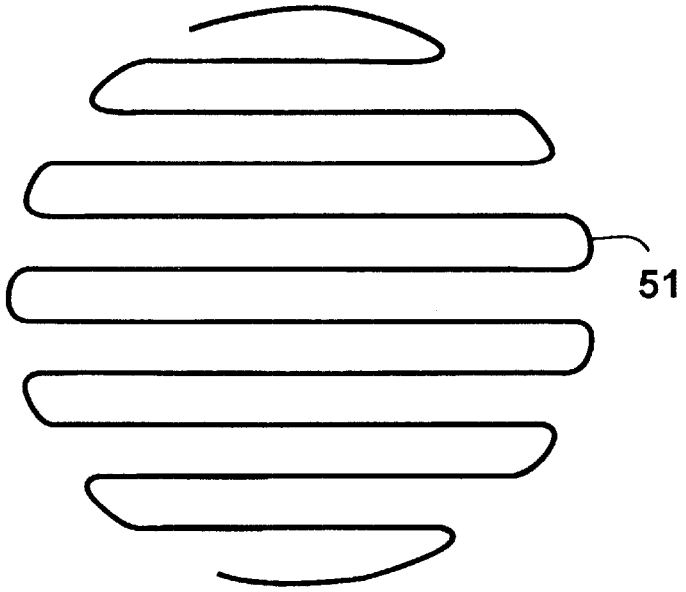
FIG. 9 shows a further embodiment of the present invention in top down view.

FIG. 9 shows an alternative spiral configuration of the present invention In this embodiment, the anode 50 is formed into a spiral that is more as a serpentine-like structure. The turns 51 of which are formed in such a manner so as to create a circular or spiral-like configuration as shown.

Figure 10:
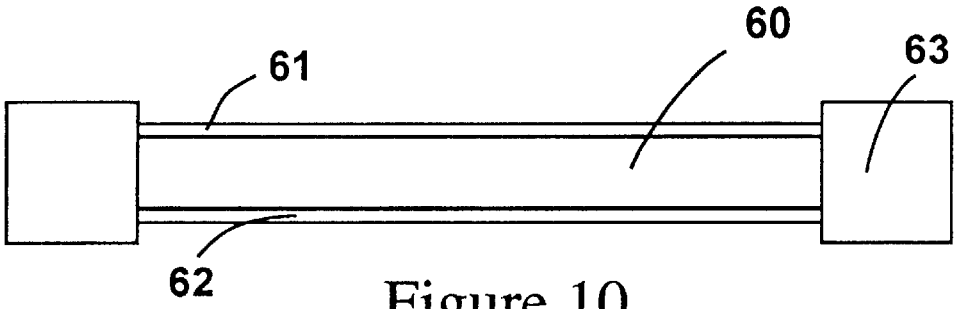
FIG. 10 shows a cross sectional view of a further embodiment of the anode of the present invention.

FIG. 10 shows an anode 60 of the present invention which is contained within a porous support device formed of a layer of porous material 61 above the anode and a layer of porous material 62 below the anode 60. Both porous layers 61 and 62 are secured to a support structure 63. In this embodiment, electrolyte flows from outside the device through layer 62, through the anode 60 and out through layer 61. Alternatively, the flow can be opposite that described above.

The anode 60 and at least a portion of the one or more buss bars, if used, are sealably enclosed within a porous structure 61,62 and 63. This porous structure allows for the movement of electrolyte and metal ions into and out of the structure, but prevents the movement of metal particles outside of the structure. If metal particles were allowed to travel through the system, they may cause damage to other components of the system. For example, metal particles deposited upon a wafer in a semiconductor plating operation would not be acceptable as they tend to form electrical bridges across circuits and also tend to form height irregularities which are not acceptable in today's multilayered systems.

The porous material may be formed of any porous material. Preferably, it is a membrane that prevents the migration of metal particles from the anode into the electrolyte and eventually to the cathode. Additionally by flowing the electrolyte through the porous structure, any other particulate material contained within the electrolyte is also removed. The membrane is preferably formed of a glass fiber, such as a woven glass fabric, non woven glass fabric or a glass mat or a polymer selected from the group consisting of polyvinyl chloride, PTFE resin, thermoplastic fluoropolymers such as PFA, MFA and FEP, polyolefin homopolymers or copolymers such as polyethylene and polypropylene, polyvinylidine fluoride (PVDF), PET, sulphones such as polysulphone and polyethersulphone and polyamides such as nylon. The pore size of the membrane should be smaller than that of the smallest particle that may become disassociated from the anode. Preferably the membrane is microporous, although it may be ultraporous or larger than microporous. Typical pore sizes range from 0.001 microns to about 10 microns. Preferably, they range from 0.005 microns to about 3 microns. Preferably, the material is. hydrophilic although neutral or hydrophobic materials may be used. The preferred hydrophilic material may be inherently hydrophilic or if not hydrophilic or strongly hydrophilic, at least its surface is rendered hydrophilic via a surface treatment or coating. One preferred method of forming a hydrophilic surface coating is described in U.S. Pat. No. 4,944,879, the teachings of which are incorporated herein by reference.

One preferred membrane that may be used in this invention is a polyethylene membrane available from Porex Technologies of Fairburn, Ga. The membrane is then treated with a hydrophilic coating as described in U.S. Pat. No. 4,944,879, which allows for better flow of the electrolyte through the membrane and avoids issues such as dewefting of the membrane which reduces membrane performance.

Figure 11:
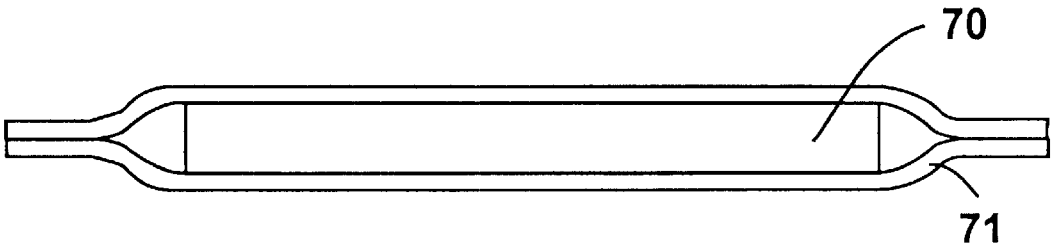
FIG. 11 shows a cross sectional view of an additional embodiment of the anode of the present invention.

FIG. 11 shows another embodiment of the present invention. In this embodiment, the anode 70 is enveloped within a porous structure 71. No support structure as shown in FIG. 10 is required. One may use a single piece of porous material 71 or two pieces of material and simply seal the edges together so as to keep the anode within the envelope.

This anode may be formed by various processes such as casting, cutting, punching or bending.

Preferably, it is formed by a bending process. In such a process, the metal selected should be ductile so that it may be formed into the desired shape and retain that shape over time. The purity of the metal depends upon the desired effect and use of the anode. For example, when the anode acts as the source of metal for the plating, it is preferred that it has a higher purity than for example when it acts simply as an anode. Additionally the purity will vary with whether the anode material is a pure metal, a blend or an alloy. Typically, the metal will have a purity of greater than 95% of the selected metal. Preferably, whether as a pure metal or alloy, the material selected will have a purity of at least 98%. When used as a source of metal in a plating system, the material, be it a sole metal or an alloy, has a purity of from about 99.9 to about 99.9999%.

The percentage of purity refers to the percentage of the material that is formed only of the desired metal or metals, whether used as a single metal, blend of metal or as an alloy or doped metal. For example, one can use a lead/tin blend that might be a 50/50 blend of the two metals. In this case, each metal and the blend itself is at least 95% pure, the remainder being impurities such as other metals, metal working lubricants, dirt, etc. if one uses a copper metal and desires a 99.99% purity that means the remainder, 0.01%, is impurities.

One method of making the anode via a bending process is to wrap a metal strip, such as a copper rod or foil around a mandrel. If desired, spacers may be inserted into the spiral as it is being formed in order to ensure that uniform spacing between the adjacent coils of the spiral is maintained. As described above, these spacers may be formed as a portion of the metal strip or they may be added separately and either secured to the anode or removed after formation.

If one desires to make the anode via a punching process, one simply selects a piece of metal that has a diameter at least as great as the diameter of the anode that is to be formed. The thickness of the metal should be as thick as possible in using the punching process so as to ensure that a suitably sized anode with sufficient mass is formed.

An anode may simply be cast into a mold in the desired spiral configuration. In this method, care should be taken to ensure that the cast is consistent throughout its structure and that uniform spiral spacing and wall dimensions are maintained. Additionally, as little scrap or flash as possible should be generated in this casting method so as to avoid any non-uniform areas on the anode. To the extent that any mold release agent is used, it should be removed from the cast structure before the anode is used. Preferably, it is removed during the cleaning step described below.

After formation of the anode into its desired shape, the anode typically is cleaned to remove any impurities or oxidation products from its surface. One suitable method for cleaning is to insert the anode into a mild acid bath. Upon removal, the anode is rinsed with water, dried and packaged in an airtight package.

Figure 12:
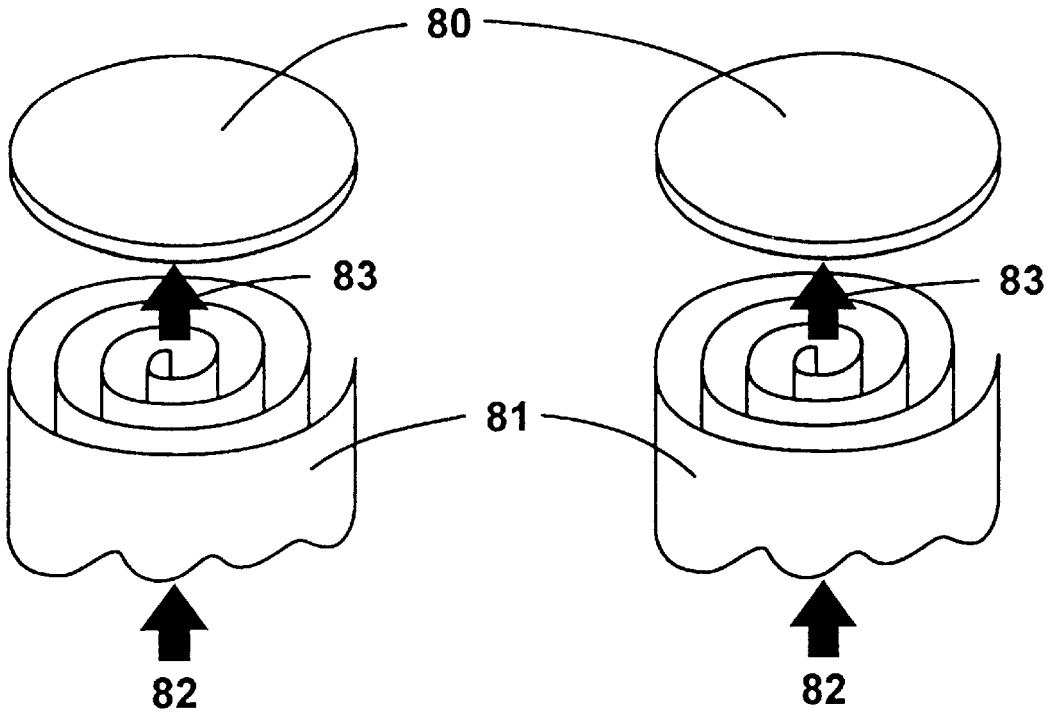
FIG. 12 shows an overall perspective view of the anode of FIG. 1 in an electroplating system.

FIG. 12 shows a schematic of how an anode made according to the present invention would be used in an electroplating bath. In this embodiment; the anode 80 is suitably placed and secured within the bath. A wafer 80 to be plated is located adjacent to but separate from the anode 81. The wafer 80 acts as the cathode of the system. Electrolyte 82 is flowed through the anode 81, i.e. through the spirals of the anode in a direction 83 perpendicular to the diameter of the anode 81. Metal is removed from the anode 81 by the electrolyte and deposited upon the wafer/cathode 80. If desired, the anode 81 may be contained within a membrane or porous structure as described above.

One such method of using the anode and a device for containing the anode is disclosed in PCT published application WO 98/39796, which is incorporated herein by its entireties.

Regardless of the method by which the anode is used, the spacing between the metal strip of the anode should always be less than the distance from the surface of the anode closest to the surface of the cathode closest to the anode. Preferably, the distance between the spiral layers is less than 25% of the distance between that of the anode and the cathode. This ensures that a uniform deposit of metal is formed on the cathode, such as a wafer or other workpiece.

The use of a spiral anode, whether it be a single spiral, double spiral, serpentine spiral, zigzag spiral or any other spiral configuration, ensures that the flow and electrical field during use remains fairly consistent and uniform throughout the life of the anode. This ensures that one obtains a uniform deposition of metal on the cathode regardless of the size or age of the anode. With other anode systems, this has not been possible due to the change in shape of the anode and its relative position to the cathode over time.

Additionally, the anode area exposed to the electrical field provides for uniform electrical field in the plating cell. The exposed area of the anode may be confined by insulative sidewalls or an insulative plate with a central portion cut out so as to cause the anode and electrical field to be focused upon the selected area of the cathode.

What is claimed is:

1. A metal anode comprising one or more distinct metal strips formed into a spiral configuration having layers, each layer spaced apart from the adjacent layer of the spiral configuration, said anode being sealably encased in a porous material with a portion of at least one of the one or more buss bars extending through the membrane.

2. The anode of claim 1, wherein the porous material is polymeric membrane.

3. The anode of claim 1, wherein the composition of the metal of the metal strips includes a metal from the group consisting of copper, nickel, gold, silver, titanium, platinum, alloys of copper, nickel, titanium and platinum.

4. The anode of claim 1, wherein the metal of the one or more metal strips has a purity of from about 95% to about 99.9999%.

5. The anode of claim 1, wherein the composition of the metal of the one or more metal strips includes a metal from the group consisting of copper and copper alloys.

6. The anode of claim 1, wherein the spiral configuration is a double spiral.

7. The anode of claim 1, wherein the spiral configuration is a single spiral.

8. The anode of claim 1, wherein the spiral configuration is a serpentine spiral.

9. The anode of claim 1, wherein said anode is sealably encased in a porous polymeric membrane, said membrane formed from a polymer selected from the group consisting of polyvinyl chloride, polytetrafluoroethylene, perfluoroalkoxy, polytetrafluoroethylene-perfluoromethylvinylether, fluorinated ethylene propylene copolymer, polyethylene, polysulfone, polypropylene, polyvinylidene fluoride and nylon.

10. The anode of claim 1, wherein the anode is encased in a porous polymer membrane and said membrane has an average pore size of from about 0.001 microns to about 5 microns.

11. The anode of claim 1, wherein the layers are uniformly spaced apart.

12. A system for electroplating comprising two or more cathodes formed of a material on which a metal is to be plated, two or more anodes formed of the metal from which the material forming the two or more cathodes is to be plated, at least one of said two or more anodes being formed in a spiral configuration, wherein each layer of the spiral configuration of at least one of said two or more anodes is uniformly spaced apart from any adjacent layer.

* * * * *